US012324954B2

(12) United States Patent
Ito et al.

(10) Patent No.: US 12,324,954 B2
(45) Date of Patent: Jun. 10, 2025

(54) LEGLESS CHAIR TYPE SEESAW EXERCISE DEVICE

(71) Applicant: Kabushiki Kaisha SANKEI, Osaka (JP)

(72) Inventors: Maika Ito, Osaka (JP); Michiyo Ito, Osaka (JP)

(73) Assignee: KABUSHIKI KAISHA SANKEI, Osaka (JP)

( * ) Notice: Subject to any disclaimer, the term of this patent is extended or adjusted under 35 U.S.C. 154(b) by 222 days.

(21) Appl. No.: 18/142,981

(22) Filed: May 3, 2023

(65) Prior Publication Data

US 2023/0364463 A1 Nov. 16, 2023

(30) Foreign Application Priority Data

May 11, 2022 (JP) ..... 2022-077960

(51) Int. Cl.
*A63B 22/16* (2006.01)
*A63B 21/00* (2006.01)

(52) U.S. Cl.
CPC ..... *A63B 22/16* (2013.01); *A63B 21/4034* (2015.10); *A63B 21/4047* (2015.10); *A63B 2208/0204* (2013.01); *A63B 2209/18* (2020.08); *A63B 2225/093* (2013.01)

(58) Field of Classification Search
CPC ..... A63B 22/14–18; A63B 26/003; A63B 2026/006; A47C 9/00
See application file for complete search history.

(56) References Cited

U.S. PATENT DOCUMENTS 4,817,950 A 4/1989 Goo
4,974,904 A * 12/1990 Phillips ..... A47C 9/002 297/258.1
5,647,830 A 7/1997 Togao
5,755,651 A * 5/1998 Homyonfer ..... A63B 22/16 482/130
5,851,166 A * 12/1998 Bernardson ..... A63B 22/16 482/79
5,897,474 A * 4/1999 Romero ..... A63B 22/14 482/79
6,379,289 B1 * 4/2002 Gossie ..... A63B 21/055 482/142

(Continued)

FOREIGN PATENT DOCUMENTS

CN 101095644 A 1/2008
CN 111346340 A * 6/2020 ..... A63B 22/16

(Continued)

*Primary Examiner* — Nyca T Nguyen
(74) *Attorney, Agent, or Firm* — Kratz, Quintos & Hanson, LLP

(57) ABSTRACT

A seesaw exercise device includes a rigid frame that has a pair of left and right side walls; and a seesaw base that is interposed between the two side walls facing each other, wherein a central portion of a horizontal base plate of the seesaw base is pivotally supported to the two side walls of the frame by a round shaft having a diameter larger than a thickness of the base plate itself, and when the base plate is pushed down by a user, the base plate performs a seesaw motion slowly in a front-rear direction while drawing an arc along a circumferential surface of the round shaft.

9 Claims, 17 Drawing Sheets

(56) References Cited

U.S. PATENT DOCUMENTS

| | | | | |
|---|---|---|---|---|
| 7,175,577 | B2 * | 2/2007 | Greenspan | A61H 1/0237 482/79 |
| 7,625,323 | B1 * | 12/2009 | Lin | A63B 22/0087 482/146 |
| 7,775,952 | B1 | 8/2010 | Curran | |
| 8,182,036 | B2 * | 5/2012 | Nishino | A47C 3/0257 297/259.1 |
| 9,446,307 | B2 * | 9/2016 | Klein | G09B 19/0038 |
| 10,376,070 | B1 * | 8/2019 | Jen | A63B 22/18 |
| 11,540,635 | B2 * | 1/2023 | Nishino | A47C 3/0257 |
| 2003/0186794 | A1 * | 10/2003 | Vittone | A63B 21/4029 482/142 |
| 2006/0270536 | A1 * | 11/2006 | Tukada | A63B 26/003 482/148 |
| 2008/0242515 | A1 | 1/2008 | Soga | |
| 2008/0207412 | A1 * | 8/2008 | Lin | A63B 23/0216 482/140 |
| 2009/0230743 | A1 * | 9/2009 | Derakhshan | A47C 9/002 297/329 |
| 2012/0252645 | A1 | 2/2012 | Kouno | |
| 2013/0274079 | A1 * | 10/2013 | Hockridge | A63B 21/4033 482/142 |
| 2014/0162852 | A1 * | 6/2014 | Ho | A63B 22/18 482/92 |
| 2018/0064988 | A1 * | 3/2018 | Xu | A63B 21/1609 |
| 2019/0104851 | A1 * | 4/2019 | Carey | A47C 7/144 |

FOREIGN PATENT DOCUMENTS

| | | | | | |
|---|---|---|---|---|---|
| CN | 115350439 | A | * | 11/2022 | |
| CN | 116808539 | A | * | 9/2023 | |
| EP | 1284152 | A1 | | 2/2003 | |
| FR | 2641183 | A | * | 7/1990 | A63B 21/00178 |
| JP | H08-299493 | A | | 11/1996 | |
| JP | 3068911 | U | | 5/2000 | |
| JP | 2002-315846 | A | | 10/2002 | |
| JP | 3099281 | U | | 4/2004 | |
| JP | 3107675 | U | | 2/2005 | |
| JP | 2009-165813 | A | | 7/2009 | |
| JP | 2018-015303 | A | | 2/2018 | |
| JP | 6802557 | B2 | | 12/2020 | |
| JP | 6821082 | B1 | | 1/2021 | |
| KR | 20100094899 | A | * | 8/2010 | |
| KR | 10-2013-0074439 | A | | 7/2013 | |
| WO | WO-2009122479 | A1 | * | 10/2009 | A63B 21/0058 |

* cited by examiner

LEGLESS CHAIR TYPE SEESAW EXERCISE DEVICE

BACKGROUND

Technical Field

The present invention relates to a legless chair type seesaw exercise device, which is useful for stretching and softening Achilles tendons, triceps muscles of lower limbs, etc., training for correcting hip joints, pelvis, etc., and other health promotion, and as safe and easy to use especially for elderly people, sick, people and physically handicapped people.

Related Art

Japanese Utility Model Registration No. 3099281 and JP H08-299493A disclose seesaw exercise devices which are intended to mainly improve muscle training of legs and loins and sense of balance by seesawing the base plate alternately in a left-right direction with both left and right feet placed on one base plate side by side.

SUMMARY

However, in the configuration of the seesaw exercise health appliance described in Japanese Utility Model Registration. No. 3099281, the rotary shaft 8 is a stainless steel rod inserted through a pedal plate 1, has a diameter smaller than the plate thickness of the pedal plate 1, and is only in line contact, so to speak, with a concave groove-shaped bearing portion 3a of the pedal plate 1, which makes it difficult for the pedal plate 1 with its fulcrum portion in the line contact state to naturally maintain the horizontal state as it is, and inevitably idles the rotary shaft 8.

Therefore, the moment when a user puts one foot on the pedal plate 1, the pedal plate 1 may be inclined so that the user hurts the ankle or falls over. Further, when the user does not forcefully step on the pedal plate 1, the pedal plate 1 may be easily and quickly inclined, and as a result, a strong force and a seesaw motion speed for enhanced training of the legs and loins are not required, and the force of action (load) applied to the legs and loins by the motion is weak and insufficient to provide a poor effect.

Further, since the rotary shaft 8 of the pedal plate 1 is configured to be removably inserted from above into the concave groove-shaped bearing portion 3a of the pedal plate 1 so that the pedal plate 1 can be replaced, the rotary shaft 8 is likely to jump out of the bearing portion 3a for the rotary shaft 8 at the first moment when one foot is placed on the pedal plate 1, and there is a danger of the user's falling off the pedal plate 1 because of the absence of a wall surrounding the user in the front-rear direction and the left-right direction. Leave aside able-bodied young men and women, therefore, the health appliance cannot be used safely and conveniently by elderly people, sickly people requiring rehabilitation, physically handicapped people, etc.

In this respect, the seesaw exercise device described in JP H08-299493A can be installed for use in a bathtub or on a floor, and can be said to be similar to the present invention in that the device includes a pair of left and right side members 13 which can be held by both hands. However, the device still has the following problems.

The main body 1 of the seesaw exercise device is a T-shaped integrated product including a horizontal pedal plate and a vertical leg board, and the lower end portion (suction cup 3) of the leg board which is in contact with the ground serves as a fulcrum, so that the entire T-shaped main body 1 alternately falls (rolls) over in the left-right direction about the fulcrum 3.

Since the T-shaped main body 1 is not configured to perform a seesaw motion with the intersection portion of the horizontal pedal plate and the vertical leg board as the fulcrum, the stability and fixing strength (rigidity) of the T-shaped main body 1 in a stationary state are poor, and a user cannot stand on the pedal plate of the T-shaped main body 1, and may inevitably fail from the pedal plate.

In this case, a pair of left and right air pumps 2 are arranged in parallel under the horizontal pedal plate of the T-shaped main body 1, whereby even when the pedal plate is received from below, the air pumps 2 are deformed by expansion and contraction due to air pressure. This does not make it possible to maintain stability and fixing strength with the pedal plate received, which is still dangerous for the elderly people and other users.

In addition, it is considered that the pair of left and right air pumps 2 are foot-operated manual pumps that are activated and generate air pressure (internal pressure) only when they are stepped on from above via the pedal plate of the T-shaped main body 1, and when the entire T-shaped main body 1 falls (rolls) over in the left-right direction, the pedal plate is inevitably inclined, and thus, the air pumps 2 cannot be reliably and stably operated.

Since the stepping force of the pedal plate is not constant and varies differently between the left and right air pumps 2, even when the pumps can be operated, the motion is not always a seesaw motion which draws a constant locus at the same inclination angle. As a result, users cannot easily understand and remember the regularity of the cause-and-effect relation, i.e., how much action force (load) can be applied to their legs and loins by how hard they step on the pedal plate, and accumulation of experience (rule of thumb) cannot be used to achieve the goal of sustaining these saw exercise.

Furthermore, receiving holes 14 are opened at both the left end portion and the right end portion of the horizontal pedal plate of the T-shaped main body 1, and a pair of side members 13, which serve as armrests, are inserted into the receiving holes 14 in a removable manner from above. However, since the pair of side members 13 are provided at the left and right end portions of the pedal plate which is moved up and down when the T-shaped main body 1 falls (rolls) over, the device cannot keep his or her posture in a stable fixed state when he or she holds the side members 13 with both hands. What is more, in the example of use shown in FIG. 10 in which both of the side members 13 are pulled out, the user may fall off the pedal plate of the main body 1, so that the device is inevitably inferior in safety.

In any case, the seesaw exercise devices described in Japanese Utility Model Registration No. 3099281 and JP H08-299493A are configured so that the pair of left and right feet placed side by side on the pedal plate are merely alternately stepped one by one to perform a seesaw motion in the left-right direction. Although the devices are useful for training the sense of balance, therefore, the devices are not useful at all particularly for stretching the Achilles tendons, the triceps surae muscles, the biceps femoris muscles, the gluteus maximus muscles, and other rear muscles of the lower body.

The present invention aims to solve these problems, and in order to achieve this purpose, according to claim 1, the present device includes a rigid frame that has a pair of left and right side walls whose upper end portions function as handrails or armrests; and a seesaw base that has a horizontal base plate interposed between the two side walls facing each other, wherein a rotary shaft for pivotally supporting a central portion of the base plate of the seesaw base to the two side walls of the frame is formed as a round shaft having a diameter larger than a thickness of the base plate itself and is extended horizontally through the two side walls of the frame, the base plate is attached to and integrated with the round shaft from above, the base plate is also attached to and integrated with a pair of front and rear parallel reinforcing bars, which hold the round shaft therebetween, from above the reinforcing bars, and the base plate of the seesaw base slowly performs a seesaw motion in a front-rear direction while drawing an arc along a circumferential surface of the round shaft when the base plate of the seesaw base is pushed down by a user.

According to claim 2, a pair of front and rear finger/toe hooking ridges are arranged in parallel on an upper surface of the base plate which performs the seesaw motion.

According to claim 3, various finger/toe hooking ridges having different sectional shapes, sizes and/or materials are attached and fixed on the upper surface of the base plate in a detachable and replaceable manner.

According to claim 4, a protective mat is laid on and integrated with the upper surface of the base plate which performs the seesaw motion, and a plurality of parallel non-slip ridges or a large number of scattered non-slip protrusions are integrally projected from the protective mat.

According to claim 5, an installation height of the base plate which performs the seesaw motion from a grounding surface is set to 120 to 160 mm inclusive, and an inclination angle of the base plate intersecting the grounding surface is set to 10 to 40 degrees inclusive.

According to claim 6, a pair of front and rear cushion stoppers for defining the inclination angle intersecting the grounding surface of the base plate which performs the seesaw motion are fixedly and horizontally mounted on the frame in a state of being in parallel with the round shaft which is used as a pivot of the base plate, or fixedly and horizontally mounted on both a front end portion and a rear end portion of the base plate in a parallel backing state.

According to claim 7, a finger insertion window is notched and opened at a position right under the upper end portion which is the handrail or the armrest in each of the two side walls of the frame, and the handrail or the armrest is capable of being grasped and held by fingers inserted from the finger insertion window, and a circular bearing opening for receiving the round shaft used as the pivot of the base plate of the seesaw base is formed correspondingly at a lower position of each of the two side walls.

According to claim 8, the frame is integrated from a rectangular wooden base board and the two side walls that are wooden and stand upright from the base board, and a pair of from, and rear cushion stoppers for receiving the base plate which performs the seesaw motion are fixed to an upper surface of the base board and a plurality of non-slip grounding leg seats are similarly fixed to a lower surface of the base board.

According to claim 9, the base plate which performs the seesaw motion is formed of a wooden material into a rectangular shape in a plan view so as to be accommodated in the frame, and the round shaft used as the pivot of the base plate is formed as a wooden round bar and is extended horizontally through the two side walls of the frame made of a wooden material.

According to the configuration of claim 1, the user places one foot or both feet on the base plate of the seesaw base in a standing posture or a sitting posture, and repeats the motion of stepping on the front end portion of the base plate with the tips of toes and the motion of stepping on the rear end portion of the base plate with the heel to alternately perform a seesaw motion in the front-rear direction, so that the device can stretch the Achilles tendons, triceps surae muscles, gluteus maximus muscles and other rear muscles of the lower body to expand the range of motion of the ankles and knee joints, etc.

Further, the user places his or her waist periphery on the base plate of the seesaw base, makes a posture of lying on the stomach or lying on the back by turning his or her upper body toward one of the front side and rear side of the base plate and turning his or her lower body toward the other remaining side of the base plate, and seesaws the base plate in the front-rear direction, so that the device can stretch his or her back muscles and abdominal muscles to expand the range of motion of the hip joints and shoulder joints, etc., exercise the pelvis, and strengthen the gluteus maximus muscles, etc.

In such a case, both flanks of the body (body sides) are required to maintain their correct postures as a restrained state in which the flanks are safely dammed by the two side walls of the rigid frame, which permits the above-described corrections of pelvis, posture, etc. to be also performed.

In addition, a rotary shaft for pivotally supporting a central portion of the base plate to the two side walls of the frame is formed as a round shaft having a diameter larger than the thickness of the base plate itself and is extended horizontally through the two side walls, and when the base plate is pushed down (stepped on) by the body of the user or a part thereof, i.e., hands or feet, the base plate performs a seesaw motion slowly in the front-rear direction to draw an arc (parabola) along the circumferential surface of the round shaft, so that combined with the restraint of the body by the two side walls of the frame, not only able-bodied young men and women, but also the elderly people, the sickly people, and the physically handicapped people can use the device safely without danger.

Further, since the upper end portions of the two side walls of the rigid frame bearing the rotary shaft (round shaft) function as handrails or armrests, the handrails or armrests can be stably grasped and used during the seesaw motion of the base plate or the device as a so-called legless chair type seesaw exercise device.

In particular, not only the central portion of the base plate is supported by the round shaft having a diameter larger than, the thickness of the base plate, but also the pair of front and rear reinforcing bars holding the round shaft therebetween are fixed in a supported state, so that the center of gravity of the base plate is located at a low position. Furthermore, the two reinforcing bars act as weights (or balancers) for resisting (braking) the rotational action of the base plate which draws the arc (parabola), and as a result, the base plate never idles in a natural state and is required to be pushed down (stepped on) forcefully by the user.

The strength of the pushing down force (stepping force) applied by the user from each of the front and rear end portions of the base plate and the speed of the seesaw motion become a load applied to the body of the user or a desired part thereof, and the load appropriately adjusted and controlled by the user can be effectively utilized for stretching, training, rehabilitation and other health promotion.

With the configuration of claim 2 adopted, fingers or toes are hanged (entangled) to any one of the pair of front and rear finger/toe hooking ridges, thereby making it possible to train the gripping force of the fingers or toes or stimulate the pressure points by placing the palm of the hand or the sole of the foot, and also making it possible to use the remaining other finger/toe hooking ridge as a stopper for preventing the drop of the foot.

In this case, adopting the configuration of claim 3 enables selection of the finger/toe hooking ridge in accordance with the desire of the user and the sex, physique, age, and the like of the user, thereby improving convenience.

The configuration of claim 4 when adopted brings about advantages such that the body or the hands or feet thereof placed on the base plate can be safely protected by the protective mat laid on the upper surface of the base plate, and that the non-slip effect for the body or the hands or feet thereof and the massage effect of shiatsu on the pressure points can be obtained with the plurality of parallel non-slip ridges and the large number of scattered non-slip protrusions projecting from the protective mat.

The configuration of claim 5 when adopted makes it possible to eliminate the feeling of anxiety of the user standing on the base plate of the seesaw base, and it is also possible to obtain the effects of stretching, training, rehabilitation and the like by making the load applied to the body of the user or a desired part thereof by the seesaw motion of the base plate sufficiently strong.

The configuration of claim 6 when adopted makes it is possible to automatically and effectively absorb abnormal sounds generated when the base plate performing the seesaw motion is pushed down (stepped on), a shock received by the user, and the like by the cushion stoppers, thereby providing a feeling of security and safety.

Adopting the configuration of claim 7 makes it possible to rationally open and form the finger insertion window at an upper position of each of the two side walls of the frame and the bearing opening for the round shaft at a lower position of each of the two side walls of the frame, so to speak, in a state of being arranged in a distributed manner, and also makes it possible to stably hold the handrail or the armrest during the seesaw motion and to carry the seesaw exercise device conveniently.

With the configuration of claim 8 adopted, the frame can be integrated in a rigid U-shape from the wooden base board and the two side walls thereof, and when combined with the addition of weight by the base board and the installation of the grounding leg seats, the configuration brings about an effect of providing stability and fixing strength to prevent skidding in a stationary state.

Further, the configuration of claim 9 when adopted brings about effects such that the legless chair type seesaw exercise device can be manufactured from a wooden material at a low cost, handled in the same manner as furniture and used indoors safely and conveniently, and is thus excellent in practicality.

DETAILED DESCRIPTION

Figure 1:
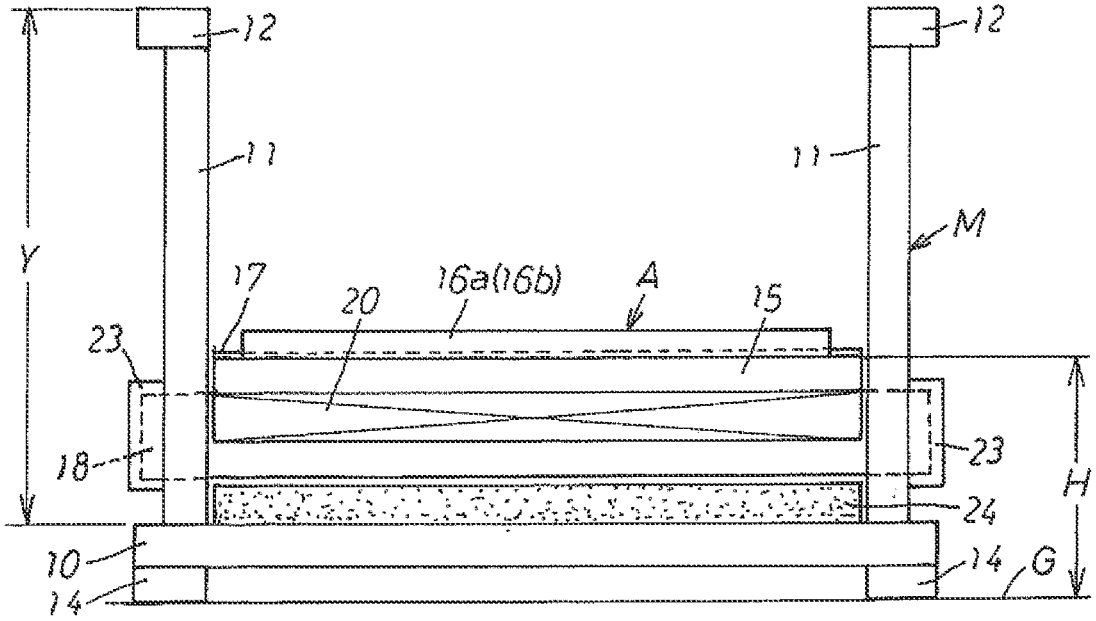
FIG. 1 is a front view of a legless chair type seesaw exercise device according to a preferred embodiment of the present invention.
Figure 2:
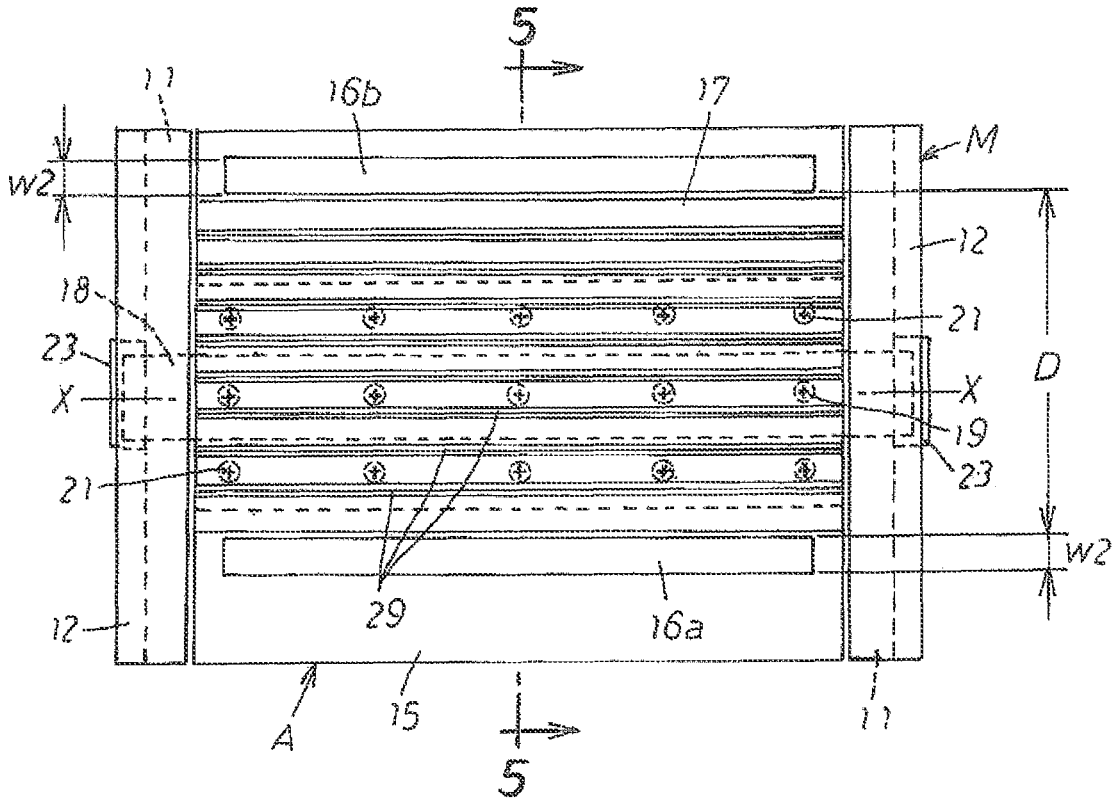
FIG. 2 is a plan view of FIG. 1.
Figure 3:
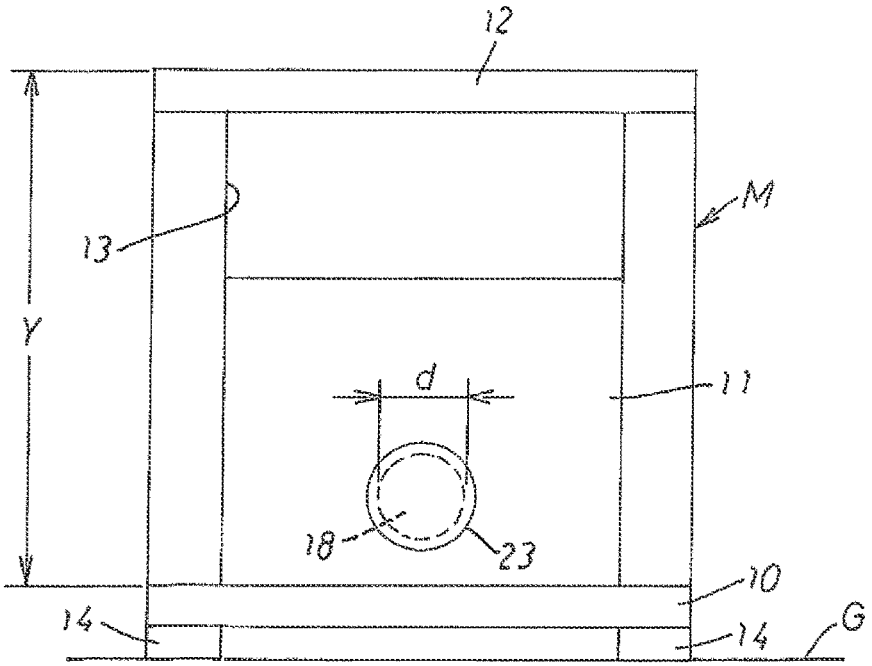
FIG. 3 is a side view of FIG. 1.
Figure 4:
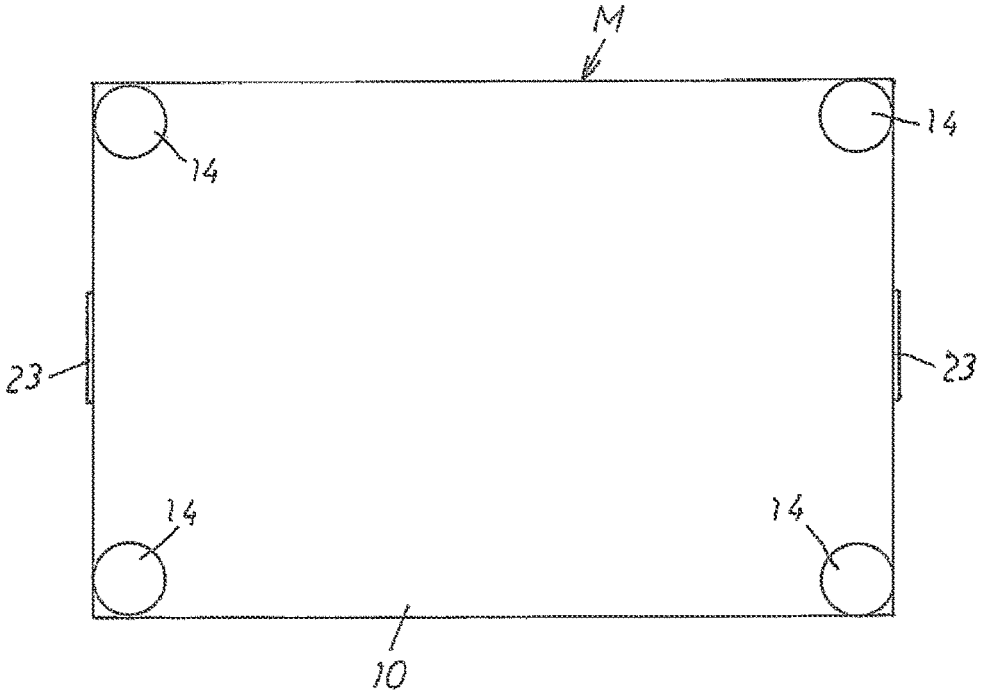
FIG. 4 is a bottom view of FIG. 1.

Hereinafter, preferred embodiments of the present invention will be described in detail with reference to the drawings. FIGS. 1 to 6 show the whole of a legless chair type seesaw exercise device made of a wooden material, wherein a rigid frame M is stably and firmly assembled and integrated by tongue-and-groove joints, spline joints, and any other joint systems of the wooden material, and a seesaw base A is pivot ably and rotatably supported inside the frame M.

Among the constituent members of such a seesaw exercise device, the frame N first includes a base board 10 having a rectangular shape (e.g., a size of 310×460 mm) in a plan view and a pair of left and right side walls 11 which face each other and integrally stand upright from the flat upper surface of the base board 10 by a constant height Y (e.g., 320 mm), with upper end portions of both of the side walls 11 being capable of functioning as handrails or armrests 12 which are parallel to each other.

In addition, relatively small rectangular (for example, 70×220 mm) finger insertion windows 13 are respectively notched and opened in the upper portions of both of the side walls 11 in such a manner as to face each other, and the handrails or armrests 12 can be gripped and held by the fingers inserted through the finger insertion windows 13 to carry the seesaw exercise device or perform seesaw motion during use. The finger insertion windows 13 at positions directly below the handrails or armrests 12 may, of course, be opened and formed in an elliptical shape or other contour shapes.

A plurality of (four in the illustration) non-slip grounding leg seats 14 are fixedly attached to the lower surfaces of the corner portions of the base board 10, and the non-slip grounding leg seats are preferably made of a rubber, synthetic resin, wooden material or the like which does not damage an indoor floor, sofa, bed or the like.

In this case, in the illustration, a plurality of grounding leg seats 14 are affixed in a scattered distribution state to the corner portions of the base board 10 made of a rectangular flat plate, and the base board 10 may be formed as parallel rails supporting a rectangular framework having a space formed therein by square bars or the like and both of the side walls 11, with two (two rows of) grounding leg seats 14 being fixedly attached in parallel to the lower surface of the base board 10.

Further, when any of the above-described grounding leg seats 14, whichever it is, is attached to the lower surface of the base board 10 via a screw fastening means (not shown) in a manner of being capable of moving up and down, it is possible to adjust an installation height of the base board 10 from a grounding surface G. It is also conceivable to employ a suction cup as the grounding leg seat 14.

The seesaw base A includes a rectangular base plate 15 having a size (e.g., 300×360 mm) interposed between the right and left side walls 11 forming the frame M, a pair of front and rear parallel finger/toe hooking ridges 16*a* and 16*b* which are fixedly attached to the upper surface of the base plate 15, and a protective mat 17 laid between the front and rear finger/toe hooking ridges 16*a* and 16*b* on the upper surface of the base plate 15.

Figure 7:
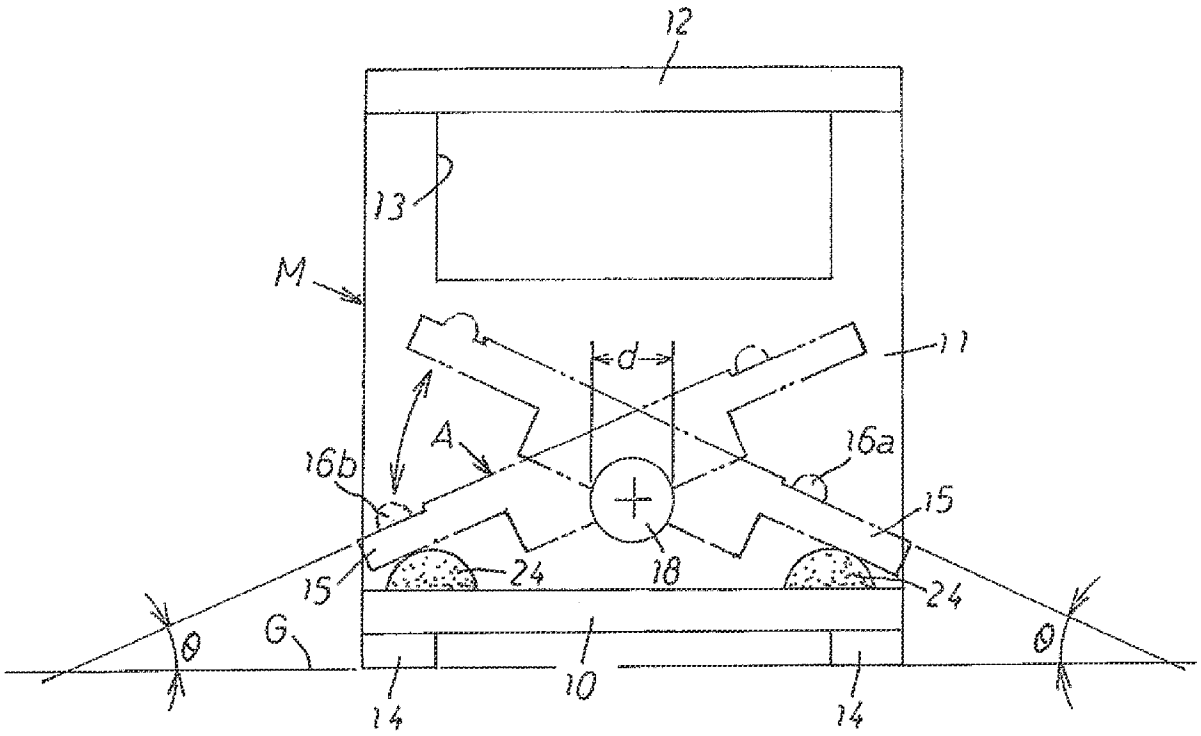
FIG. 7 is a side view for describing a seesaw motion of a base plate.

The base plate 15 is a wooden material having a constant plate thickness t (for example, 18 to 25 mm inclusive), and the central portion of the base plate 15 is pivotally supported to the two side walls 11 of the frame M via a round shaft 18 made of a wooden round bar, and when the front end portion and the rear end portion of the base plate 15 are alternately pushed down (stepped on) by the user, they perform a seesaw motion (swing in the front-rear direction) as shown in FIG. 7.

Figure 5:
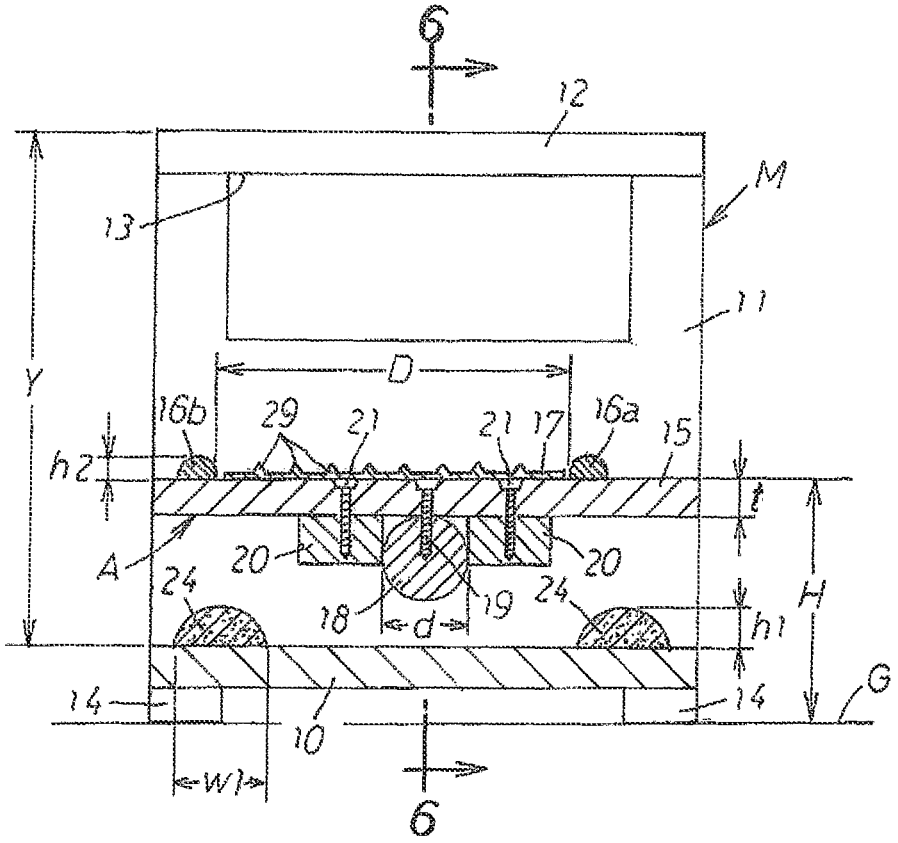
FIG. 5 is a sectional view taken along line 5-5 in FIG. 2.
Figure 6:
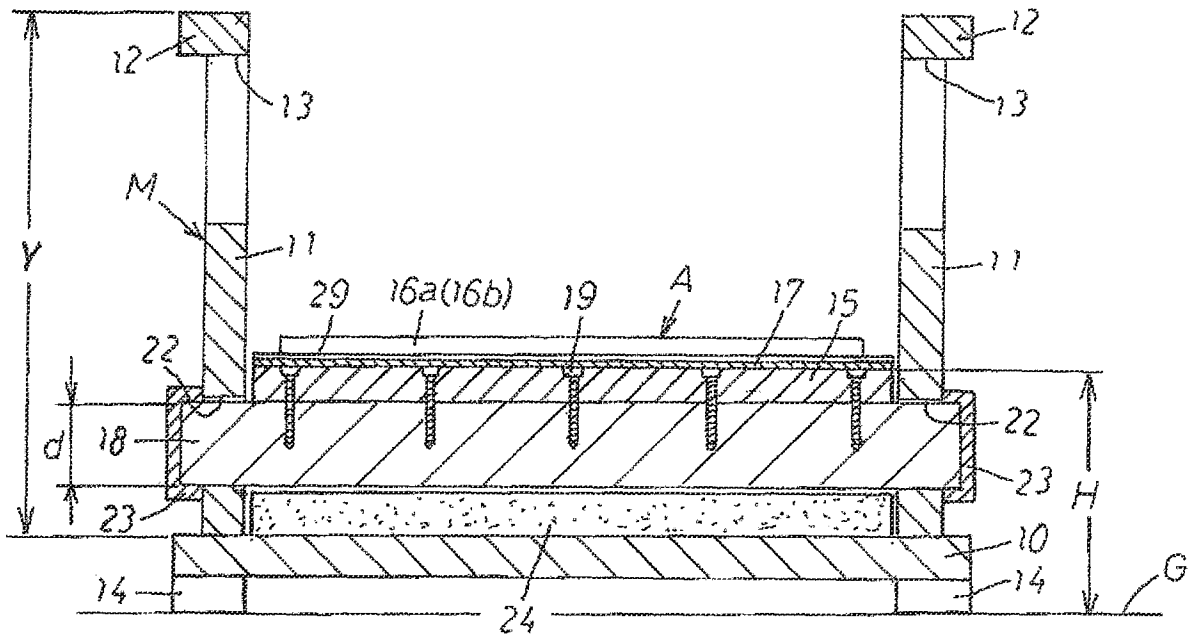
FIG. 6 is a sectional view taken along line 6-6 in FIG. 5.

As is apparent from FIGS. 5 and 6, the round shaft 18 pivotally supporting the base plate 15 is extended horizontally through the lower portions of both of the side walls 11 of the frame M as a rotary shaft having a diameter d (preferably 40 to 50 mm inclusive) which is larger than the thickness t of the base plate 15.

In a state in which the central portion of the base plate 15 is in line contact with the circumferential surface of the rotary shaft (round shaft) 18 from above, the round shaft 18 and the base plate 15 are assembled and integrated by a plurality of (five in the illustration) flat-headed screws 19 which are screwed in from above in the same manner.

Moreover, the rotary shaft (round shaft) 18 is firmly and stably held in the front-rear direction by a pair of parallel reinforcing bars 20 similarly made of a wooden square bar, and added with a weight capable of braking the base plate 15. A plurality of (also five in the illustration) flat-headed screws 21 are screwed into each of the two reinforcing bars 20 from above the base plate 15, and the base plate 15 and the two reinforcing bars 20 are assembled and integrated together.

That is, the central portion of the base plate 15 is made heavier than both front and rear end portions by the rotary shaft (round shaft) 18 having the diameter d larger than the plate thickness t and the pair of reinforcing bars 20 holding the rotary shaft (round shaft) 18 therebetween. When it is assumed that the base plate 15 is now in a horizontal state, in the natural state of the base plate 15, the rotary shaft (round shaft) 18 does not idle, and the base plate can be inclined when and only when, so to speak, it is artificially pushed down from either one of the front or rear end portion of the base plate 15. The base plate 15 once inclined does not return to the horizontal state by itself, and the rotary shaft (round shaft) 18 supporting the central portion of the base plate 15 contributes to lowering the center of gravity, so that the base plate 15 does not naturally idle and can be kept in the horizontal state.

With the base plate 15 set in this way, the user needs to forcefully push down (step on) the base plate 15 of the seesaw base A, and the base plate 15 receiving the pushing down force (stepping force) is also subjected to the braking force (resistance to rotation) of the weight added by the two reinforcing bars 20 while drawing an arc (parabola) along the large-diameter circumferential surface of the rotary shaft (round shaft) 18 to perform a seesaw motion in the front-rear direction slowly (gradually). This allows the device to be used in various ways for the purpose of stretching, training, rehabilitation and other health promotion of the body without feeling anxious.

In this regard, when the pivotal portion, which performs the seesaw motion, of the base plate 15 is in point contact or line contact, or when the center of gravity of the base plate 15 is at a position higher than the pivotal portion, the base plate 15 can hardly maintain its natural horizontal state and is quickly inclined at an instant once it receives a light pushing down force (stepping force) of the user, and thus, in addition to the danger of hurting the ankle or falling over for the user, the strength of the pushing down force (stepping force) applied from the from and rear end portions of the base plate 15 and the speed of the seesaw motion cannot be adjusted and controlled by oneself.

A bearing opening 22 off the rotary shaft (round shaft) 18 is formed as a circular opening facing the lower portions of both of the side walls 11. A friction member (not shown) serving as a brake shoe of the rotary shaft (round shaft) 18 may be interposed between the rotary shaft (round shaft) 18 and the bearing opening 22, A safety cap 23 is integrally attached to each of the two end portions of the rotary shaft (round shaft) 18 exposed from the two side walls 11, and the safety cap is made of a hard synthetic resin, rubber or the like which is also useful for decorating the two end portions.

In any case, the base plate 15 of the seesaw base A supported by the horizontal rotary shaft (round shaft) 18 extending in the left-right direction of the frame M and the pair of the front and rear reinforcing bars 20 holding the rotary shaft (round shaft) 18 therebetween is at a constant installation height. H (e.g., 120 to 160 mm inclusive) from the grounding surface G (the lower surface of the grounding leg seat 14) and rotates together with the rotary shaft (round shaft) 18 to perform a seesaw motion (swing in the front-rear direction) as shown in FIG. 7 so that the front end portion and the rear end portion of the base plate 15 alternately rise and fall evenly.

A pair of front and rear cushion stoppers 24 restrict an inclination angle θ, at which the base plate 15 intersects the grounding surface G, by receiving both of the end portions of the base plate 15, which performs the seesaw motion, from below, wherein the front and rear cushion stoppers are in the form of rides which are made of a rubber, sponge, or soft synthetic resin, or other elastic materials and have a semicircular cross section or a chevron cross section with a constant width W1 (e.g., 60 mm) and a constant height h1 (e.g., 30 mm) and are fixed in parallel to the upper surface of the base board 10.

Since both cushion stoppers 24 receive the base plate 15 performing the seesaw motion as a pillow having elasticity, the cushion stoppers can effectively absorb a shock, an abnormal sound, or the Like generated when the base plate 15 is pushed down (stepped on), and are also useful for security and safety. When it is possible to obtain the effect of absorbing the shock, however, the abnormal sound, or the like, the pair of the cushion stoppers 24 may be integrally attached to the lower surfaces of the front and rear end portions of the base plate 15 in a backing state as parallel ridges projecting oppositely downward.

The inclination angle θ of the base plate 15 which performs the seesaw motion is set to, for example, 10 to 40 degrees inclusive, preferably 20 to 30 degrees inclusive. When the installation height H of the base plate 15 is higher than 160 mm and the inclination angle θ of the base plate 15 is a steep angle larger than 40 degrees, the user may feel anxious and may slip down from the base plate 15 particularly when the user stands on both feet during use.

On the other hand, when the installation height H of the base plate 15 is less than 120 mm and the inclination angle θ is a gentle angle smaller than 10 degrees, there is no risk of slipping down from the base plate 15, so that while the base plate 15 can be used safely and securely, the seesaw motion of the base plate 15 causes weakness or insufficiency in stretching, training, rehabilitation, and other action forces applied to the user's body, and strong and sufficient effects cannot be expected.

In this sense, it is preferable that the installation height H of the base plate 15 is set to 140 to 150 mm inclusive and the inclination angle θ of the base plate 15 is set to 20 to 30 degrees inclusive. In the illustration, the installation height H is set to 145 mm and the inclination angle θ is set to 25 degrees.

The two finger/toe hooking ridges 16*a* and 16*b* of the seesaw base A are each made of a solid rubber body, each have a semicircular cross section or a chevron cross section having a constant width W2 (e.g., 15 to 20 mm inclusive) and a constant height h2 (e.g., 15 to 20 mm inclusive), and each extend in the left-right direction along the rotary shaft (round shaft) 18, and the finger/toe hooking ridges 16*a* and 16*b* are designed to be used in the form of hanging (entangling) the fingers of the hand or the toes of the foot on either one or both of the pair of front and rear parallel ridges which maintain a constant separation distance D (e.g., 200 to 250 mm inclusive) to exercise the gripping force of the fingers or toes, or in the form of placing the palm of the hand or the sole (bottom surface) of the foot on the ridges to stimulate the pressure points (so-called shiatsu massage).

In the case of the illustration, the solid rubber body is adhered and fixed to the upper surface of the base plate 15, but a hollow body may be employed instead of the solid body to exhibit high elasticity, and a synthetic resin, a wooden material, or the like which is harder than the rubber may be formed into a triangular, quadrangular or any other polygonal sectional shape.

In addition, in the illustration, a pair of front and rear parallel finger/toe hooking ridges 16*a* and 16*b* having the same sectional shape, material, and size including the width w2 and the height h2 are arranged near the asymmetrical front and rear ends having a lengthwise (near or far) difference in the separation distance from an axial line X-X of the round shaft (rotary shaft) 18, but the pair of front and rear parallel finger/toe hooking ridges 16*a* and 16*b* may also be arranged near the front and rear ends which are symmetrical about the axial line X-X of the round shaft (rotary shaft) 18. The sectional shape, the material and/or the size of the pair of the front and rear finger/toe hooking ridges 16*a* and 16*b* may be changed to be different from each other.

Figure 8:
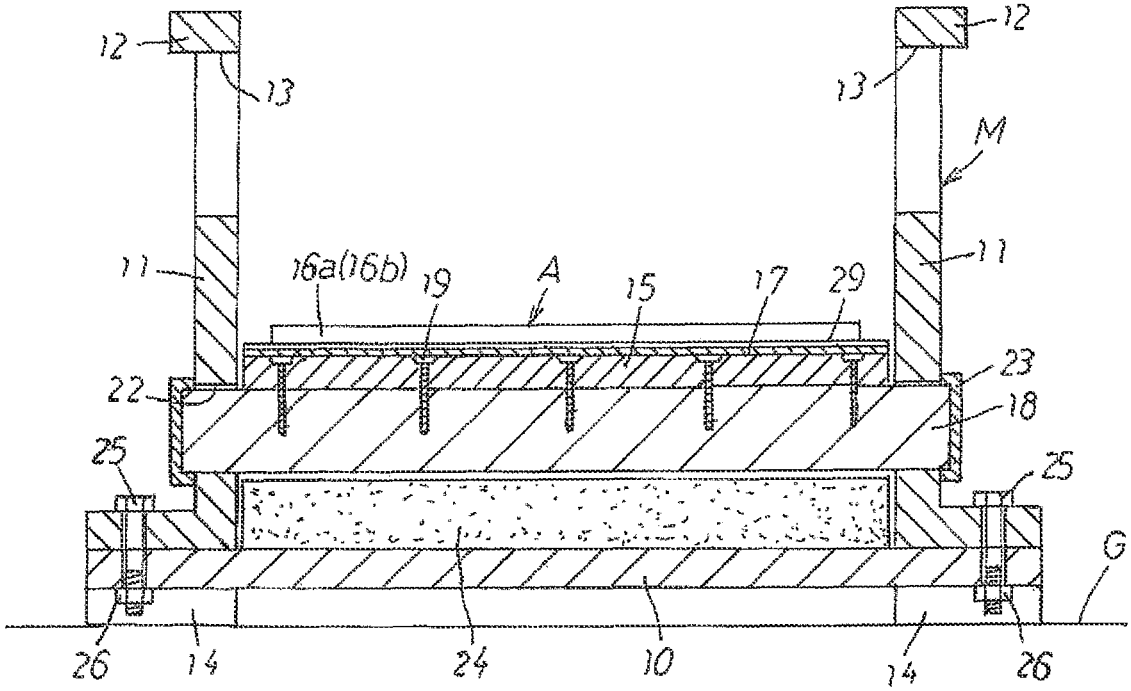
FIG. 8 is a sectional front view showing a partially modified embodiment of a configuration in which a base board and two side walls are assembled together.
Figure 9:
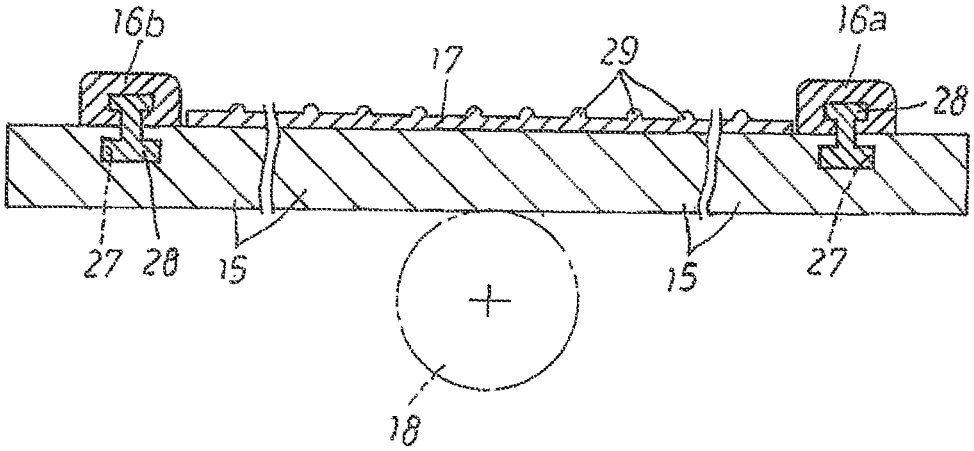
FIG. 9 is a side sectional view showing a partially modified embodiment of a configuration in which a finger/toe hooking ridge is attached to the base plate.

Further, as is clear from the partially modified embodiment shown in FIGS. 8 and 9 which exemplify another mounting means for the finger/toe hooking ridges 16*a* and 16*b*, both of the end portions of the rotary shaft (round shaft) 18 to which the base plate 15 is attached and fixed are removably inserted into and extended through the bearing openings 22 opened in the two side walls 11 of the frame M, and the two side walls 11 are removably assembled and integrated with the upper surface of the base board 10 respectively by a plurality of mounting bolts 25 and corresponding fixing nuts 26, etc., and alternatively, leg rails 28 to which various finger/toe hooking ridges 16*a* and 16*b* having different sectional shapes, materials and/or sizes, etc. are integrally attached as crowns may be removably inserted and fixed in the left-right lateral direction into grooves (slide guide grooves) 27 such as channel grooves or dovetail grooves pre-notched in the base plate 15, or various separate finger/toe hooking ridges 16*a* and 16*b* may be removably inserted and fixed in the left-right lateral direction to the locking head portions of the leg rails 28 integrally projecting upward from the base plate 15.

The common leg rails 28 inserted into the former grooves 27 and the separate finger/toe hooking ridges 16*a* and 16*b* inserted to the latter leg rails 28 may be made of a synthetic resin or rubber extruded material, or a machined wood, etc.

Figure 10:
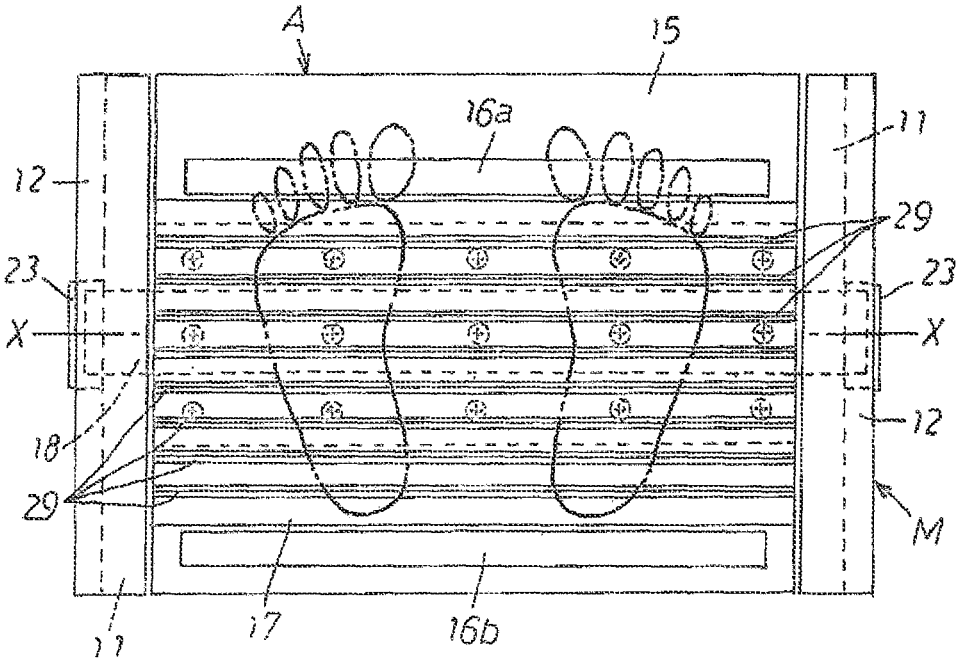
FIG. 10 is a plan view showing a positional relation between feet placed on the base plate.
Figure 11:
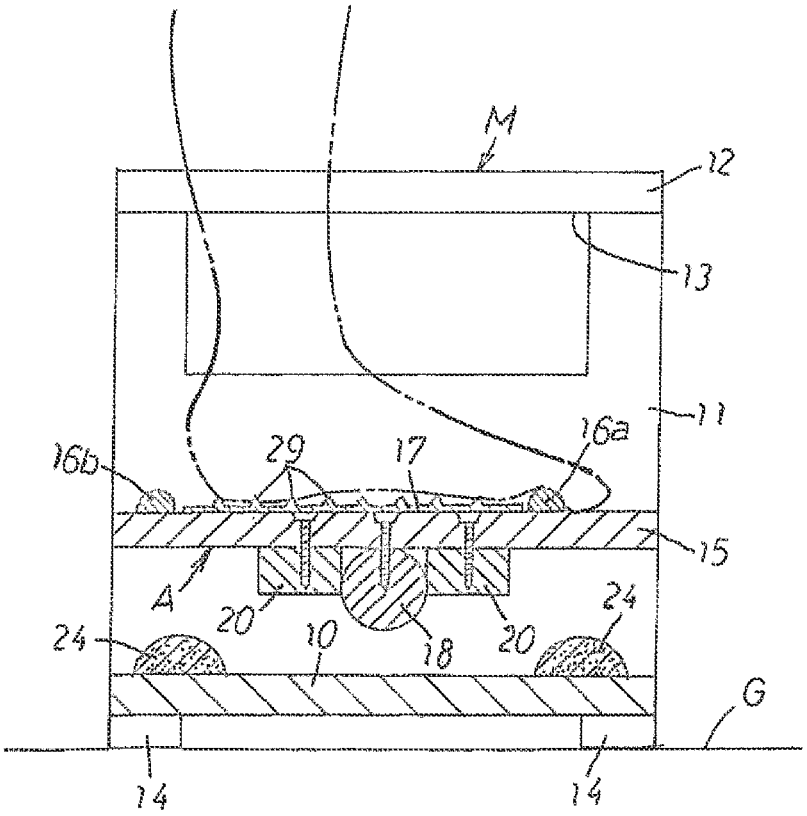
FIG. 11 is a side sectional view of FIG. 10.

In any case, when the user places his or her feet on the base plate 15 of the seesaw base A, as shown in FIGS. 10 and 11, the middle parts in length of the feet are positioned on the axial line X-X of the rotary shaft (round shaft) 18, and a plurality of desired toes including his or her big toes are hanged. (entangled) on the finger/toe hooking ridge 16*a* near one of the front and rear ends of the base plate 15, and meanwhile, the heels of the feet may or may not be placed on the other remaining finger/toe hooking ridge 16*b*.

Since the length of the user's feet may be shorter than the separation distance D between the parallel finger/toe hooking ridges 16*a* and 16*b* arranged near the front and rear ends of the base plate 15, the other finger/toe hooking ridge 16*b* may serve as a stopper for preventing the user's feet from falling from the base plate 15 of the seesaw base A when the heels of the feet are not placed.

Further, the protective mat 17 of the seesaw base A is made of a rubber, soft synthetic resin, or thermoplastic elastomer, or other elastic materials, and is integrally attached to the upper surface of the base plate 15 in order to protect the user's hands, feet, etc. Moreover, a plurality of fine non-slip ridges 29 having a chevron cross section are arranged on the protective mat 17 in parallel with the rotary shaft (round shaft) 18 and the finger/toe hooking ridges 16*a* and 16*b*.

Although not illustrated, as long as the user's hands and feet placed on the protective mat 17 of the base plate 15 can be kept in a non-slip state and the pressure points on the palms of the hands and soles (bottom surfaces) of the feet can be stimulated (so-called shiatsu massage), a large number of scattered non-slip protrusions may be integrally projected from the upper surface of the protective mat 17 instead of the non-slip ridges 29, or the upper surface of the protective mat 17 itself may be formed as a rough surface.

In any case, by laying the protective mat 17 on the upper surface of the base plate 15, the large number of the flat-headed screws 19 and 21 which integrally assemble the base plate 15 with each or the rotary shaft (round shaft) 18 and the pair of front and rear reinforcing bars 20 are all covered from above, and thus, the exposed head portions of the flat-headed screws 19 and 21 do not injure the hands and feet of the user, and the upper surface of the base plate 15 can be easily cleaned.

The legless chair type seesaw exercise device according to the illustrated preferred embodiment has the above-described configuration, and thus can be used in various ways for the purposes of not only stretching desired parts of the body as shown in FIGS. 12 to 20, but also training, rehabilitation, and other health promotion.

Figure 12:
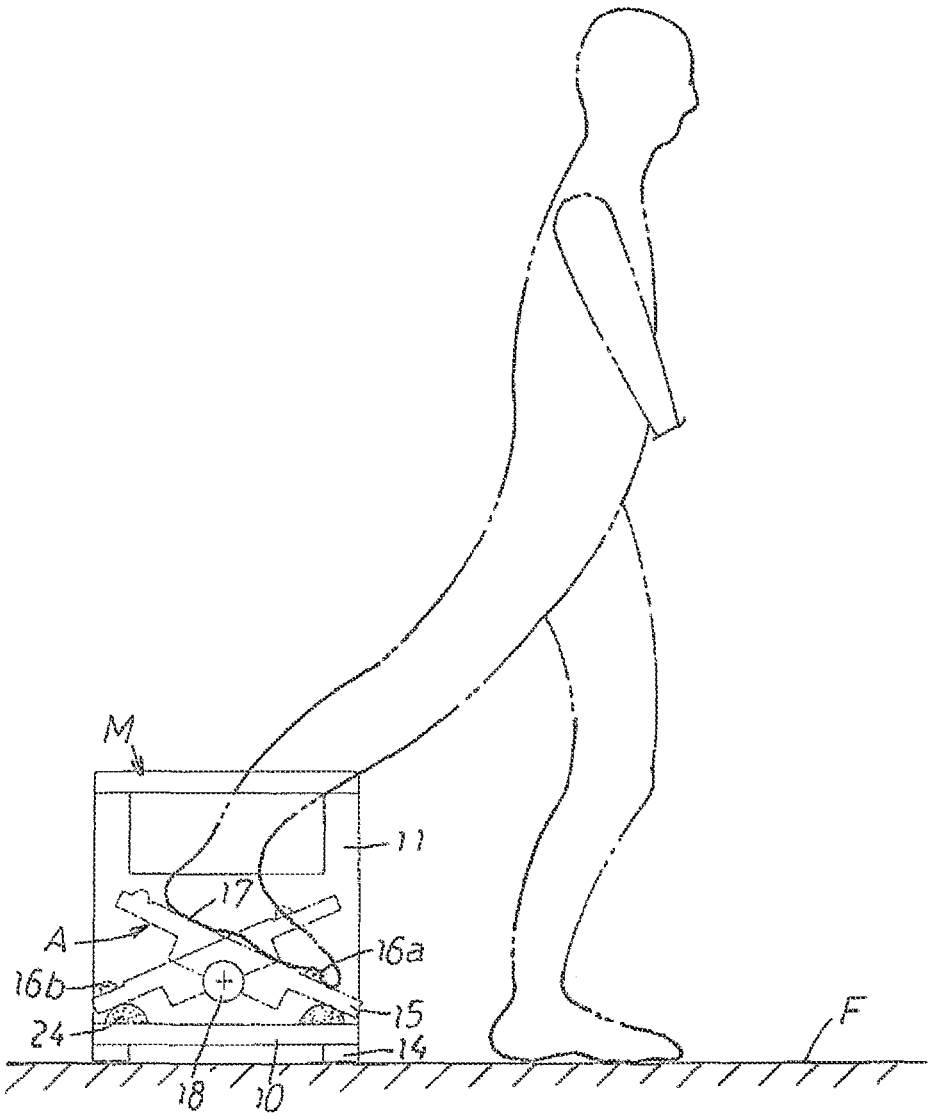
FIG. 12 is a side view showing a first example of use of the seesaw exercise device.
Figure 13:
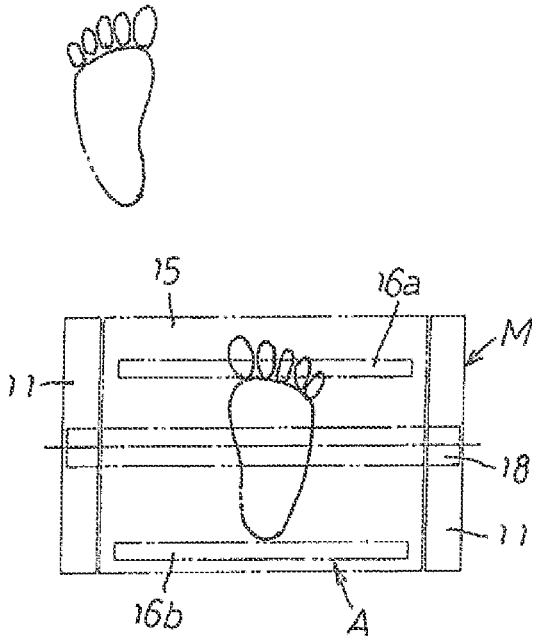
FIG. 13 is a plan view showing the positional relation between the feet shown in FIG. 12.

That is, among FIGS. 12 to 20, which show various examples of use, in the first example of use shown in FIGS. 12 and 13, the user places one foot at a time on the base plate 15 of the seesaw base A while standing on a floor F or sitting on a chair, and repeats a motion of stepping on the base plate 15 with the heel of one foot in a backward-sloping state and a motion of stepping on the base plate 15 with the tips of toes of that foot in a forward-sloping state. This stimulates and strengthens the user's tibialis anterior and tibialis posterior muscles, etc. and allows the user to obtain flexibility of the ankle joint.

Figure 14:
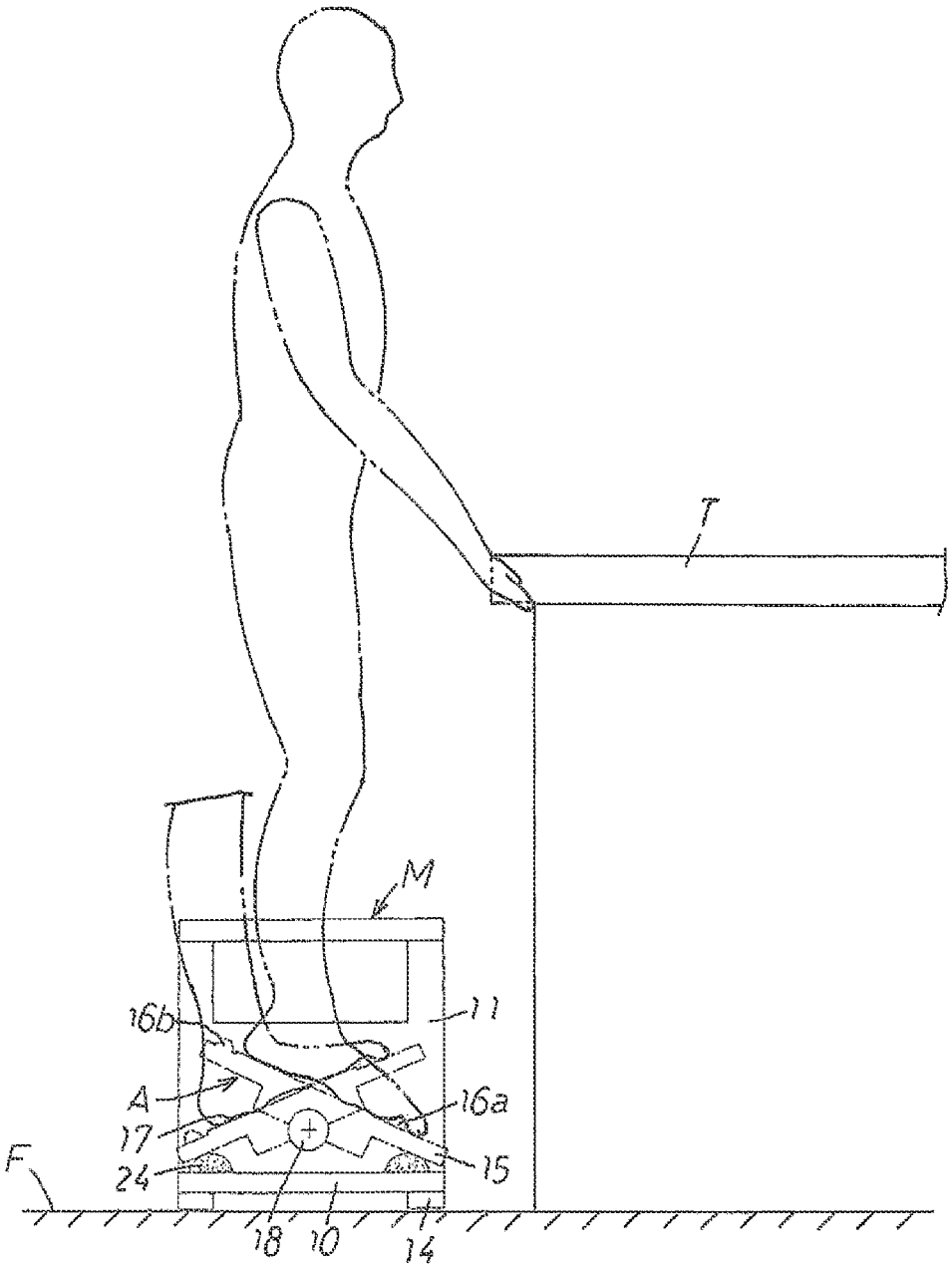
FIG. 14 is a side view showing a second example of use of the seesaw exercise device.
Figure 15:
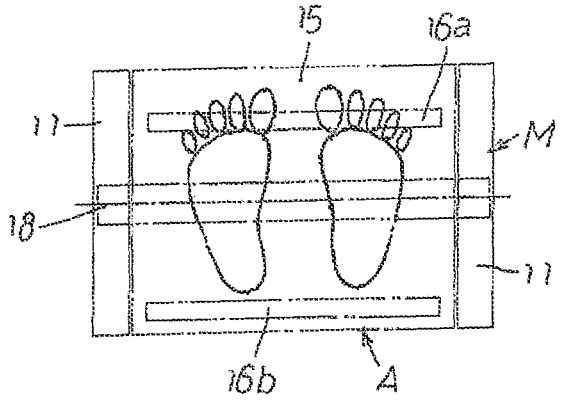
FIG. 15 is a plan view showing the positional relation between the feet shown in FIG. 14.

In the second example of use shown in FIGS. 14 and 15, the user places both feet on the base plate 15 of the seesaw base A while standing safely and holding an unillustrated pole or a desk top T, etc. erected on the floor with both hands, or sitting on a chair, and repeats a motion of stepping on the base plate 15 with the heels of both feet in the backward-sloping state and a motion of stepping on the base plate 15 with the tips of toes of both feet in the forward-sloping state. Accordingly, the user's Achilles tendon and triceps surae muscles (soleus and gastrocnemius muscles), etc. can be stretched. Especially, the above-described motions, when performed by the user in a standing posture, are useful for training the sense of balance, whereas the above-described motions, when performed by the user in a sitting posture, are useful for training the pelvis and strengthening the pelvic floor muscles, etc.

Figure 16:
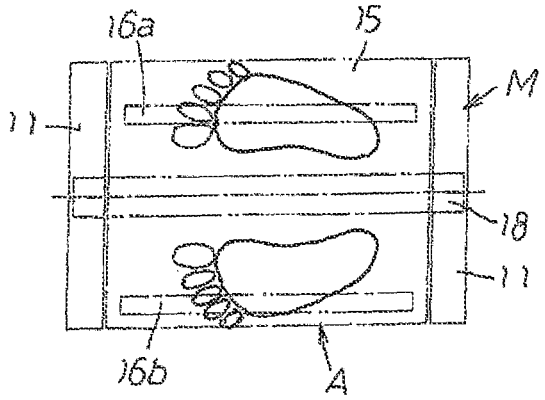
FIG. 16 is a plan view showing a third example of use of the seesaw exercise device in terms of a positional relation between the feet placed on the base plate.

In the third example of use shown in FIG. 16, the user places both feet on the front and rear end portions of the base plate 15 of the seesaw base A while standing safely and holding a pole or a handrail (handle), neither shown, etc. erected on the floor with one hand or both hands placed on a wall, or sitting on a chair, and alternately repeats the motion of pushing down (stepping on) the front end portion of the base plate 15 with the left or right foot and the motion of similarly pushing down (stepping on) the rear end portion of the base plate 15 with the remaining other foot. Accordingly, the device can correct the pelvis, hip joints, posture, etc., and especially, the above-described motions, when performed by the user in a standing posture, are useful for training the sense of balance.

In any of the first to third examples of use shown in FIGS. 12 to 16, a plurality of desired toes including particularly the big toe of one or both feet which are placed on the base plate 15 of the seesaw base A, as is apparent from the enlarged views of FIGS. 10 and 11, are hanged (entangled) on the finger/toe hooking ridge 16*a* which is either at the front or the rear, so that the gripping force (toe strength) of the toes and the plantar muscles, etc. can be strengthened and trained.

In addition, the protective mat 17 provided with a plurality of non-slip ridges 29 is laid on the upper surface of the base plate 15, and the sole (bottom surface) of one or both feet placed on the base plate 15 is always locked with the non-slip ridges 29, thereby stimulating pressure points (so-called shiatsu massage) and promoting blood circulation.

Figure 17:
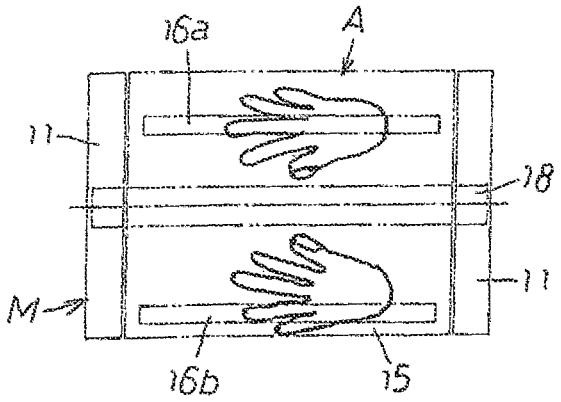
FIG. 17 is a plan view showing a fourth example of use of the seesaw exercise device in terms of a positional relation between hands placed on the base plate.

In the fourth example of use shown in FIG. 17, the user places both hands on the front and rear end portions of the base plate 15 of the seesaw base A with the seesaw exercise device placed on an unillustrated sofa, bed, etc., and alternately repeats the motion of pushing down and inclining the front end portion of the base plate 15 with one hand either on the left or right and the motion of similarly pushing down and inclining the rear end portion of the base plate 15 with the remaining other hand, which motions are useful for training to improve the flexibility of the wrist joint.

At this time, hanging the fingers of both hands on the pair of front and rear finger/toe hooking ridges 16*a* and 16*b* arranged on the base plate 15 or pressing the palm of the hand against the non-slip ridges 29 of the protective mat 17 can stimulate the pressure points of the palm of the hand (shiatsu massage), and may provide the blood circulation promoting effect.

Figure 18:
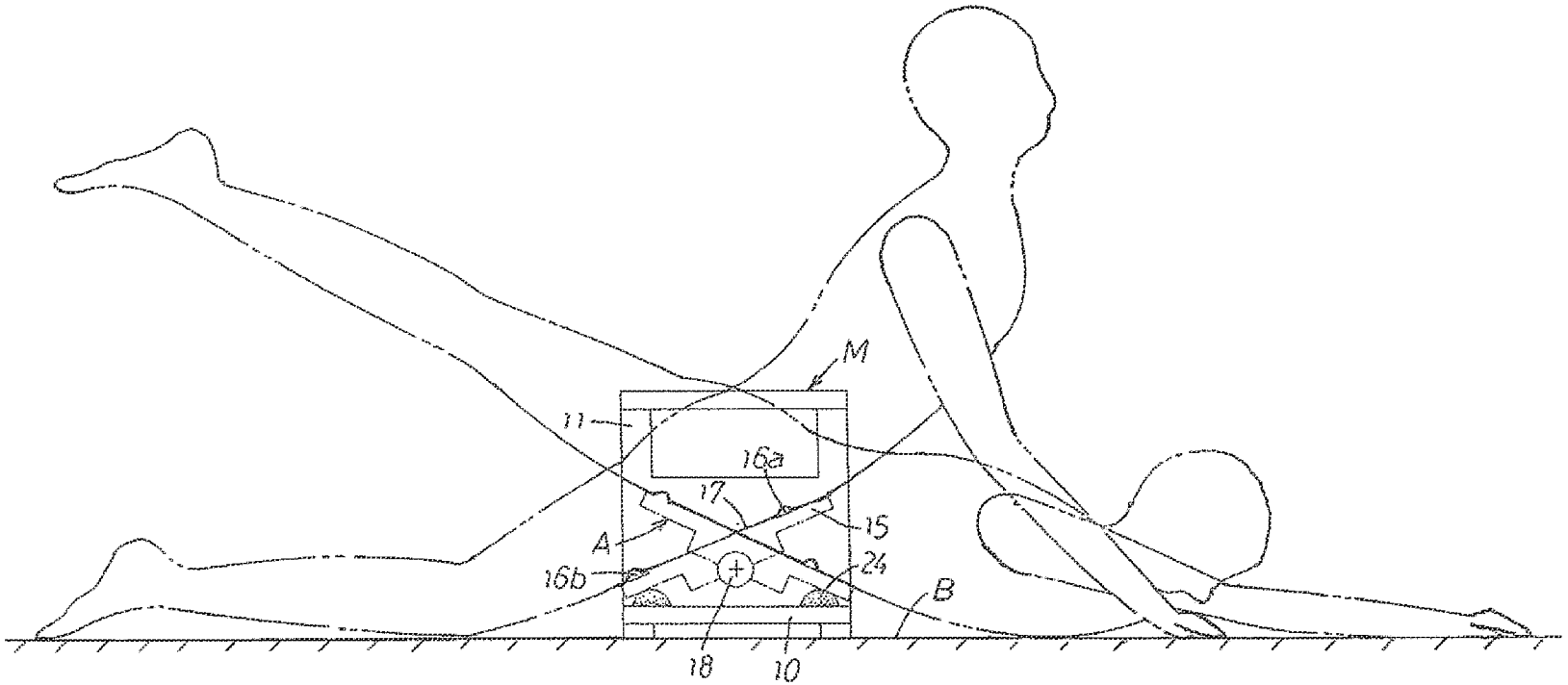
FIG. 18 is a side view showing a fifth example of use of the seesaw exercise device.
Figure 19:
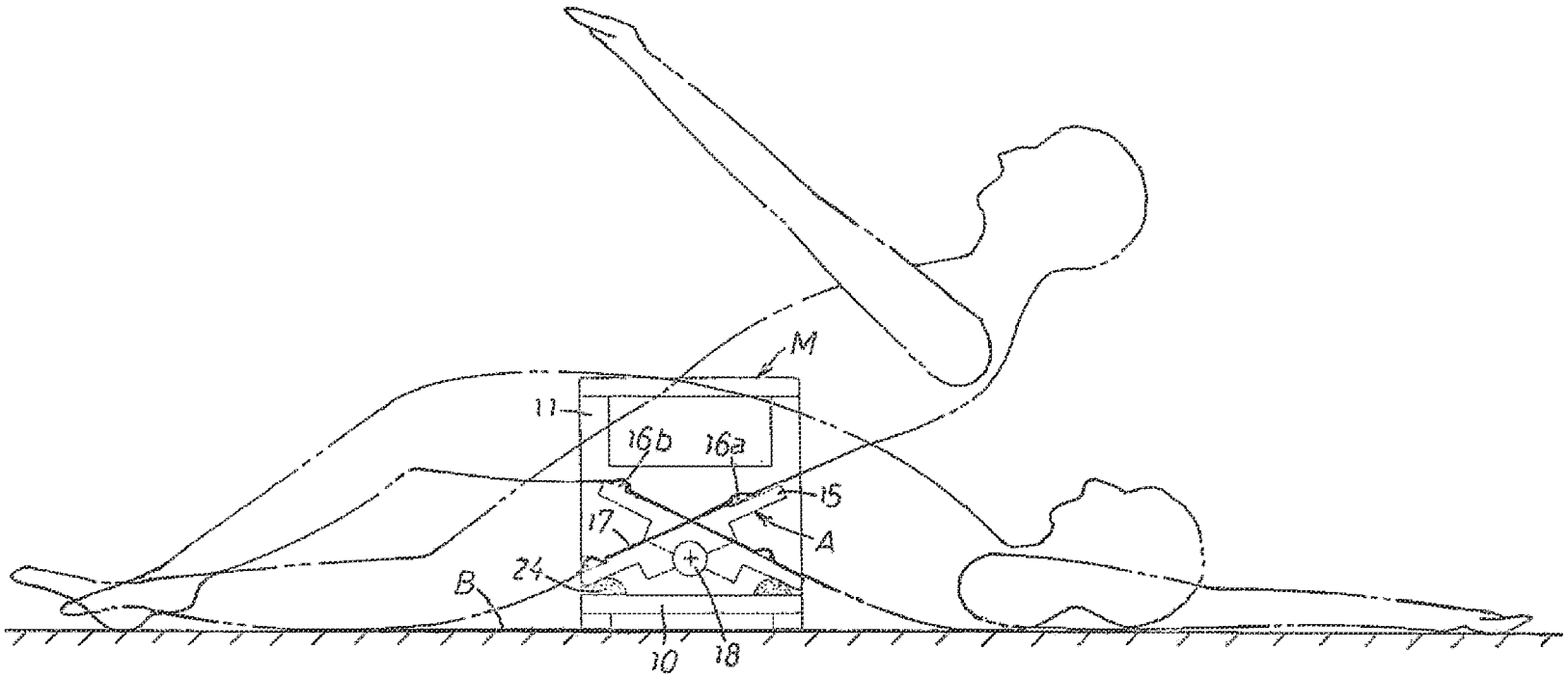
FIG. 19 is a side view showing a sixth example of use of the seesaw exercise device.
Figure 20:
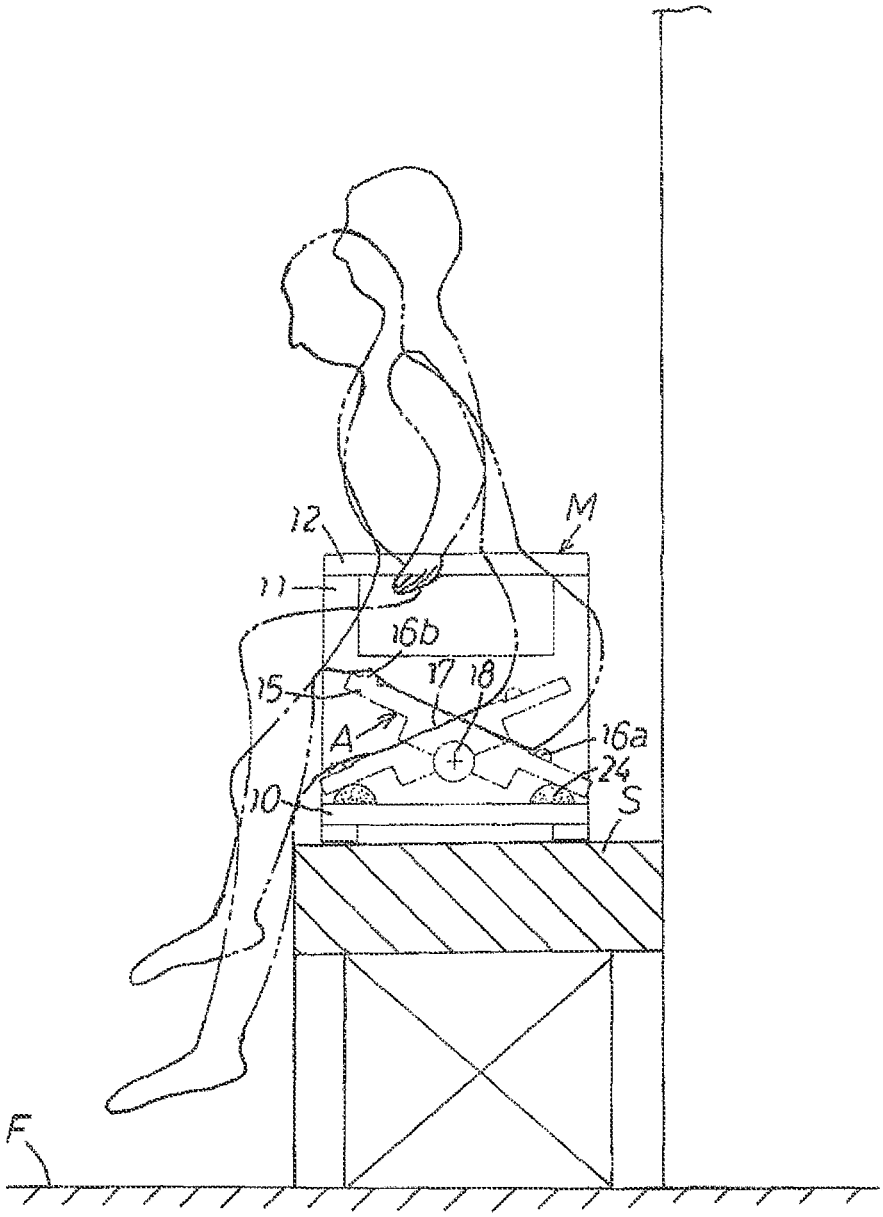
FIG. 20 is a side view showing a seventh example of use of the seesaw exercise device.

Further, as shown in the fifth to seventh examples of use shown FIGS. 18 to 20, the legless chair type seesaw exercise device can be used to allow the user to perform stretching, training, rehabilitation or the like of the upper body (arms, shoulders, back) by placing not only the lower body (mainly legs and loins) but also the periphery of the waist of the body on the base plate 15.

In other words, in the fifth example of use shown in FIG. 18, the user places his or her belly in a posture of lying on the stomach on the base plate 15 of the seesaw base A with the seesaw exercise device place on a bed B or sofa, and alternately pushes down and inclines the front and rear end portions of the base plate 15 by the belly while repeating push-ups (bending of the arms). This can, for example, strengthen the muscles of both arms and improve the flexibility of the periphery of the scapulae, and at the same time, can strengthen back muscles, etc. when the user adds the motion of bending the back and the motion of raising both legs from the sofa or the bed B.

On the other hand, in the sixth example of use shown in FIG. 19, the user places his or her back in a lying down posture on the base plate 15 of the seesaw base A with the seesaw exercise device placed on the bed B or sofa, and alternately pushes down and inclines the front and rear end portions of the base plate 15 with his or her back while repeatedly bending his or her arms and the upper half of his or her body together, thereby causing the device to correct his or her shoulder joints and spine, etc.

In the seventh example of use shown in FIG. 20, with the seesaw exercise device placed on a sofa S or bed, the user sits on the base plate 15 of the seesaw base A with his or her both feet off the ground, and swings his or her upper body in the front-rear direction and moves his or her hip (buttocks) up and down to alternately make seesaw motion of the base plate 15 in the front-rear direction while holding the handrails or armrests 12 of the seesaw base A with both hands, thereby causing the device to correct the pelvis and hip joints, strengthen the pelvic floor muscles and gluteus maximus muscles, and extend the sacrospinalis muscles, etc.

The seesaw exercise device of the illustrated preferred embodiment is of a legless chair type, wherein the frame M is rigidly assembled and integrated from the base board 10 and the pair of left and right side walls 11 so that the body of the user placed on the base plate 15 of the seesaw base A or a part of his or her body, i.e., hands or feet are dammed by the two side walls 11 of the frame and thus, in any of the first to seventh examples of use shown in FIGS. 12 to 20, and especially in the fifth to seventh examples of use shown in FIGS. 10 to 20, the device can keep a stable posture, such as lying on the stomach, lying on the back, or sitting up, and elderly people, sickly people, physically handicapped people, etc. can also use the seesaw exercise device safely without fear of falling off the base plate 15.

The base plate 15 of the seesaw base A, which has a rectangular planar shape with a size with which it can be interposed between the left and right side walls 11 of the frame M, is supported by the round shaft (rotary shaft) 18 having the diameter d larger than the plate thickness t and the pair of reinforcing bars 20 holding the round shaft. (rotary shaft) 18 therebetween in the front-rear direction in a state of being heavy at the central portion of the base plate 15 (a state in which the center of gravity is located at a low position of the central portion), and performs a seesaw motion in which the base plate 15 is gently inclined in the front-rear direction so as to draw an arc (parabola) along the large-diameter circumferential surface of the round shaft (rotary shaft) 18 in cooperation with the braking force (resistance to rotation) of the weight added by the two reinforcing bars 20 when the pushing down force (stepping force) of the user is received from each of the front and rear end portions which are relatively lighter than the central portion.

Therefore, the user must adjust and control the strength of the force pushing down (stepping on) the base plate 15 from each of the front and rear end portions and the speed of the alternately inclining seesaw motion by himself or herself, giving effective stretching, training, rehabilitation and other action forces (loads) to the target part of the body, which, as described in the first to seventh examples of use shown in FIGS. 12 to 20, can provide strengthening and flexibility of the ankle and hip joints, stabilization and correction of the pelvis and posture, extension of the Achilles tendon and triceps surae muscles, and other effects.

Further, since the pair of front and rear cushion stoppers 24 for receiving the base plate 15 from below during the seesaw motion of the base plate 15 are made of rubber, sponge or the like which literally has a cushioning capability, the shock, abnormal sound or the like generated when the base plate 15 is pushed down (stepped on) is naturally effectively absorbed. In this sense, the motion of pushing down (stepping on) can be stably repeated without danger for the user.

In the illustrated embodiment and the partially modified embodiment thereof, the base board 10 and the two side walls 11 of the frame M are assembled for integration from a wooden board material as a product of a seesaw exercise device made of a wooden material, and meanwhile, the base plate 15 of the seesaw base A is also made of a wooden board material, thus bringing about such an advantage that the device can be handled as a warm piece of furniture indoors, and is light and easy to carry for elderly users.

Board materials of various kinds of fiber-reinforced resin (FRP) or other hard synthetic resin may be adopted as the base plate 15, and a hard synthetic resin or metal pipe rod material may be adopted as the rotary shaft (round shaft) 18 instead of a round bar of a wooden material. Further, as long as the frame M can maintain rigidity so as not to be improperly deformed, the device may be stably and firmly assembled from a hard synthetic resin material, an aluminum extruded material (light metal material), a steel material of a chevron mold, an H mold, a channel groove mold, or any other mold, etc.

What is claimed is:

1. A legless chair type seesaw exercise device comprising:

a frame that is rigid and has a pair of left and right side walls whose upper end portions function as handrails or armrests; and a seesaw base that has a horizontal base plate which is interposed between the two side walls facing each other, wherein a rotary shaft for pivotally supporting a central portion of the base plate of the seesaw base to the two side walls of the frame is formed as a round shaft having a diameter larger than a thickness of the base plate itself and is extended horizontally through the two side walls of the frame, the base plate is attached to and integrated with the round shaft from above the round shaft, the base plate is attached to and integrated with a pair of front and rear parallel reinforcing bars, which hold the round shaft therebetween, from above the reinforcing bars, and the base plate of the seesaw base slowly performs a seesaw motion in a front-rear direction while drawing an arc along a circumferential surface of the round shaft when the base plate of the seesaw base is pushed down by a user.

2. The legless chair type seesaw exercise device according to claim 1, wherein a pair of front and rear finger/toe hooking ridges are arranged in parallel on an upper surface of the base plate which performs the seesaw motion.

3. The legless chair type seesaw exercise device according to claim 2, wherein various finger/toe hooking ridges having different sectional shapes, sizes and/or materials are attached and fixed on the upper surface of the base plate in a detachable and replaceable manner.

4. The legless chair type seesaw exercise device according to claim 1, wherein a protective mat is laid on and integrated with the upper surface of the base plate which performs the seesaw motion, and a plurality of parallel non-slip ridges or a large number of scattered non-slip protrusions are integrally projected from the protective mat.

5. The legless chair type seesaw exercise device according to claim 1, wherein an installation height of the base plate which performs the seesaw motion from a grounding surface is set to 120 to 160 mm inclusive, and an inclination angle of the base plate intersecting the grounding surface is set to 10 to 40 degrees inclusive.

6. The legless chair type seesaw exercise device according to claim 1, wherein a pair of from, and rear cushion stoppers for defining the inclination angle intersecting the grounding surface of the base plate which performs the seesaw motion are fixedly and horizontally mounted on the frame in a state of being in parallel with the round shaft which is used as a pivot of the base plate, or fixedly and horizontally mounted on both a front end portion and a rear end portion of the base plate in a parallel backing state.

7. The legless chair type seesaw exercise device according to claim 1, wherein a finger insertion window is notched and opened at a position right under the upper end portion which is the handrail or the armrest in each of the two side walls of the frame, and the handrail or the armrest is capable of being grasped and held by fingers inserted from the finger insertion window, and a circular bearing opening for receiving the round shaft used as the pivot of the base plate of the seesaw base is formed correspondingly at a lower position of each of the two side walls.

8. The legless chair type seesaw exercise device according to claim 1, wherein the frame is integrated from a rectangular wooden base board and the two side walls that are wooden and stand upright from the base board, and a pair of front and rear cushion stoppers for receiving the base plate which performs the seesaw motion are fixed to an upper surface of the base board and a plurality of non-slip grounding leg seats are similarly fixed to a lower surface of the base board.

9. The legless chair type seesaw exercise device according to claim 1, wherein the base plate which performs the seesaw motion is formed of a wooden material into a rectangular shape in a plan view so as to be accommodated in the frame, and the round shaft used as the pivot of the base plate is formed as a wooden round bar and is extended horizontally through the two side walls of the frame made of a wooden material.

* * * * *